US008011928B1

(12) United States Patent
Schaeffer et al.

(10) Patent No.: US 8,011,928 B1
(45) Date of Patent: Sep. 6, 2011

(54) MINE-LIKE EXPLOSION SIMULATOR

(75) Inventors: Diana P. Schaeffer, Denville, NJ (US); Cindy G. Gibson, Oklahoma City, OK (US)

(73) Assignee: Pacific Coast Systems, Asbury, NJ (US)

( * ) Notice: Subject to any disclaimer, the term of this patent is extended or adjusted under 35 U.S.C. 154(b) by 521 days.

(21) Appl. No.: 12/324,495

(22) Filed: Nov. 26, 2008

Related U.S. Application Data

(60) Provisional application No. 61/004,577, filed on Nov. 27, 2007.

(51) Int. Cl.
*F41A 33/00* (2006.01)

(52) U.S. Cl. ..... 434/11

(58) Field of Classification Search ..... 434/11, 434/16; 102/401, 407, 411, 424, 426, 428, 102/498

See application file for complete search history.

(56) References Cited

U.S. PATENT DOCUMENTS

| | | | | |
|---|---|---|---|---|
| 1,370,193 | A | | 3/1921 | Crocker |
| 2,396,699 | A | | 3/1946 | Hayes et al. |
| 2,421,491 | A | | 6/1947 | Gearon et al. |
| 2,526,670 | A | | 10/1950 | Kissinger et al. |
| 2,717,533 | A | | 9/1955 | Wells |
| 2,962,965 | A | | 12/1960 | Farnsworth et al. |
| 3,054,870 | A | | 9/1962 | Wagoner |
| 3,336,870 | A | | 8/1967 | Gunyan et al. |
| 3,535,809 | A | | 10/1970 | Hoffmann |
| 3,721,190 | A | | 3/1973 | Lewis et al. |
| 3,752,082 | A | | 8/1973 | Kernan |
| 3,808,940 | A | | 5/1974 | Schillreff et al. |
| 4,014,262 | A | | 3/1977 | Betts |
| 4,217,717 | A | | 8/1980 | Canty et al. |
| 4,245,403 | A | | 1/1981 | Hipp |
| 4,307,665 | A | | 12/1981 | Block et al. |
| 4,325,304 | A | | 4/1982 | Ormiston |
| 4,342,556 | A | | 8/1982 | Hasse |
| 4,389,947 | A | | 6/1983 | King et al. |
| 5,074,793 | A | * | 12/1991 | Hambric et al. ..... 434/11 |
| 5,117,731 | A | | 6/1992 | Mendenhall |
| 5,157,222 | A | | 10/1992 | La Mura et al. |
| 5,207,579 | A | * | 5/1993 | Campagnuolo ..... 434/11 |
| 5,216,965 | A | | 6/1993 | Liptak et al. |

(Continued)

FOREIGN PATENT DOCUMENTS

DE 3506412 A1 6/1989

(Continued)

OTHER PUBLICATIONS

U.S. Appl. No. 10/713,127 for Multi-Purpose Pyrotechnic Trainer, filed Nov. 14, 2003—Application and Figures as filed.

(Continued)

*Primary Examiner* — Kurt Fernstrom
(74) *Attorney, Agent, or Firm* — Greenberg Traurig,LLP

(57) ABSTRACT

Mine-like explosion simulators are disclosed herein. According to aspects illustrated herein, a landmine simulator device includes a blast fixture; a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover being configured so as to release a visible signature externally for maximum exposure.

20 Claims, 7 Drawing Sheets

U.S. PATENT DOCUMENTS

| | | | | |
|---|---|---|---|---|
| 5,235,127 | A | 8/1993 | Findley | |
| 5,282,455 | A | 2/1994 | Adamson et al. | |
| 5,381,721 | A | 1/1995 | Holmstrom et al. | |
| 5,450,686 | A | 9/1995 | La Mura et al. | |
| 5,460,096 | A | 10/1995 | Kothe | |
| 5,554,817 | A | 9/1996 | La Mura et al. | |
| 5,559,303 | A | 9/1996 | La Mura et al. | |
| 5,563,366 | A | 10/1996 | La Mura et al. | |
| 5,585,595 | A | 12/1996 | Dix | |
| 5,688,124 | A | 11/1997 | Salzeder | |
| 5,719,501 | A * | 2/1998 | Spektor et al. | 324/345 |
| 5,739,459 | A | 4/1998 | La Mura et al. | |
| 5,739,462 | A | 4/1998 | Poor et al. | |
| 5,767,437 | A | 6/1998 | Rogers | |
| 5,801,322 | A * | 9/1998 | Laine et al. | 102/401 |
| 5,824,945 | A | 10/1998 | Barlog et al. | |
| 5,877,448 | A * | 3/1999 | Denton et al. | 102/401 |
| 5,944,502 | A | 8/1999 | Denchfield | |
| 6,101,950 | A | 8/2000 | Kothe | |
| 6,205,927 | B1 | 3/2001 | Findley | |
| 6,237,273 | B1 | 5/2001 | La Mura et al. | |
| 6,318,350 | B1 | 11/2001 | Williams | |
| 6,393,990 | B1 | 5/2002 | Fagan | |
| 6,431,070 | B1 | 8/2002 | La Mura | |
| 6,502,343 | B2 | 1/2003 | Cheng | |
| 6,505,558 | B1 | 1/2003 | La Mura et al. | |
| 6,553,912 | B2 * | 4/2003 | Wygant | 102/498 |
| 6,599,127 | B1 | 7/2003 | Hopmeier et al. | |
| 6,845,715 | B2 | 1/2005 | Sansolo | |
| 7,066,320 | B2 | 6/2006 | Sansolo | |
| 7,083,414 | B2 | 8/2006 | Sansolo | |
| 7,314,005 | B2 | 1/2008 | Deye | |
| 7,387,073 | B2 | 6/2008 | Bodley et al. | |
| 2002/0144620 | A1 | 10/2002 | Scherer et al. | |
| 2006/0123684 | A1 | 6/2006 | Bunney | |
| 2006/0162602 | A1 | 7/2006 | Garms et al. | |
| 2007/0015115 | A1 | 1/2007 | Jones et al. | |
| 2007/0166667 | A1 | 7/2007 | Jones et al. | |
| 2007/0199469 | A1 | 8/2007 | Zahn | |
| 2008/0000377 | A1 | 1/2008 | Doyle et al. | |
| 2008/0280264 | A1 | 11/2008 | Segall | |

FOREIGN PATENT DOCUMENTS

| | | | |
|---|---|---|---|
| DE | 196 17 060 | C2 | 11/1997 |
| DE | 196 17 061 | C2 | 11/1997 |
| WO | WO 2008/097324 | | 8/2008 |

OTHER PUBLICATIONS

Apr. 15, 2005 Office Action received in U.S. Appl. No. 10/713,127 for Multi-purpose Pyrotechnic Trainer, filed Nov. 14, 2003.

Jul. 25, 2006 Office Action received in U.S. Appl. No. 10/713,127 for Multi-purpose Pyrotechnic Trainer, filed Nov. 14, 2003.

Apr. 16, 2008 Office Action received in U.S. Appl. No. 10/713,127 for Multi-purpose Pyrotechnic Trainer, filed Nov. 14, 2003.

U.S. Appl. No. 11/427,855 for Simulating an Explosion of an Improvised Explosive Device, filed Jun. 30, 2006—Application and Figures as filed.

Oct. 9, 2008 Office Action received in U.S. Appl. No. 11/427,855 for Simulating an Explosion of an Improvised Explosive Device, filed Jun. 30, 2006.

Oct. 7, 2008 ISR/WO received in PCT Patent Application Serial No. PCT/US07/071063 for Simulating an Explosion of an Improvised Explosive Device, filed Jun. 13, 2007.

Jan. 6, 2009 IPRP received in PCT Patent Application Serial No. PCT/US07/071063 for Simulating an Explosion of an Improvised Explosive Device, filed Jun. 13, 2007.

Erwin, Sandra I., "Mock 'IEDs' Help Soldiers Prepare for War", National Defense Magazine, http://www.nationaldefensemagazine.org/issues/2005/dec1/UF-Mock.htm, 3 pgs., Dec. 2005.

* cited by examiner

MINE-LIKE EXPLOSION SIMULATOR

RELATED APPLICATIONS

This application claims the benefit of and priority to U.S. Provisional Application Ser. No. 61/004,577, filed Nov. 27, 2007, the entirety of this application is hereby incorporated herein by reference.

FIELD OF INVENTION

The present invention is generally directed towards mine-like explosion simulators, and is more specifically directed towards devices and systems structurally designed to channel a blast internally for maximum sound, while releasing excess pressure that can result from the blast. The main blast resulting from a detonation is channeled low and away from the underside of a vehicle passing by or overhead.

BACKGROUND OF INVENTION

Enemy combatants often use explosive devices such as improvised explosive devices (IEDs) to cause damage, injury, and death. Landmines, which are one type of an IED, pose an extreme threat to military and law enforcement personnel and are widely used in warfare. There are two types of landmines—anti-tank (AT) and anti-personnel (AP). AT landmines are designed to immobilize or destroy vehicles and their occupants. An AT landmine produces a mobility kill (M-Kill) or a catastrophic kill (K-Kill). An M-Kill destroys one or more of the vehicle's vital drive components (for example, breaks a track on a tank) and immobilizes the target, but does not always destroy the weapon system and/or the crew (i.e., they may continue to function). In a K-Kill, the weapon system and/or the crew is destroyed. AP landmines can kill or incapacitate their victims. The AP landmines commit medical resources, degrade unit morale, and damage non-armored vehicles. Some types of AP landmines may even break or damage the track on armored vehicles.

Protection of vehicles and personnel against landmine threats is an important issue in the area of defense research. Accordingly, personnel are trained to deal with landmine-like explosions. During training, military and law enforcement personnel use IED simulators that help personnel identify landmines and react to their effects in real-time simulations. Landmine simulators should provide the power of an explosion—realistic sound with visual impact—a live training scenario without the likelihood of injury.

SUMMARY OF INVENTION

Mine-like explosion simulators are disclosed herein. According to aspects illustrated herein, a landmine simulator device includes a blast fixture; a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover being configured so as to release a visible signature externally for maximum exposure.

According to aspects illustrated herein, a landmine training system includes a landmine training simulator device having a blast fixture; a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover being configured so as to release a visible signature externally for maximum exposure; a firing unit operable to simulate one or more distinct signatures of an explosive device; and a power pack operable to provide power to, and control operation of, said firing unit.

According to aspects illustrated herein, a landmine training system includes a landmine training simulator device having a blast fixture; a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover including a top wall and two side walls sloping down so as to engage said top plate, and being configured so as to release a visible signature externally for maximum exposure, and being configured so as to produce a concussion effect, said two side walls interrupted with at least one opening so as to release excess pressure resulting from a detonation; a firing unit positioned within said distal end of said lower portion and operable to simulate an audio and a visible signature of a type classified round, said firing unit including two receptacles each capable of receiving at least two different types of type classified rounds, each of said receptacles having a first boring having a first diameter, a second boring having a second diameter, which is greater than said first diameter, and a third boring positioned between said first boring and said second boring, said third boring having a third diameter, which is greater than said first diameter but less than said second diameter; a power pack in operable communication with said firing unit, said power pack providing power to control operation of said firing unit, said power pack having multi-triggering user-controlled capabilities chosen from one of radio-controlled (RC) detonation, victim-operated (VO) detonation, command/hard wired (CW) detonation, disable power/jamming functions, or combinations thereof; and at least one external triggering device in operable communication with said power pack by way of plug and play cable connection, said triggering device controllable by a user to trigger detonation of said type classified rounds.

BRIEF DESCRIPTION OF THE DRAWINGS

The presently disclosed embodiments will be further explained with reference to the attached drawings, wherein like structures are referred to by like numerals throughout the several views. The drawings shown are not necessarily to scale, with emphasis instead generally being placed upon illustrating the principles of the presently disclosed embodiments.

FIG. 2A shows a perspective view of the device illustrated in FIG. 1. FIG. 2B shows a perspective view of a firing unit that can be used with the device illustrated in FIG. 2A to provide a realistic sound and visual signature. FIG. 2C shows a perspective view of a power pack that can be used to receive a command to detonate, and respond to the command, by detonating the firing unit;

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION OF THE INVENTION

The present invention relates to devices and systems for simulating a mine-like explosion. The systems of the present invention can simulate a landmine, which is a form of an improvised explosive device (TED), and provides realistic, yet safe, audio and visual simulations of explosions. The systems of the present disclosure generally include a structurally designed blast fixture device for channeling a blast internally for maximum sound, while releasing excess pressure that can result from the blast. The main blast resulting from a detonation is channeled low and away from the underside of a vehicle passing by or overhead. In an embodiment, when a detonation occurs, the structural design of the blast fixture is capable of producing a concussion effect, so that during an anti-tank (AT) or other type of landmine simulation exercise, occupants of a vehicle can feel a shock. At least one firing unit is moveably positioned within a portion of the blast fixture, and provides a material or a cartridge that can simulate a visual/audible signature (blast). A power pack in operable communication with the at least one firing unit provides the power and the logic necessary to detonate the material or cartridge of the firing unit. A trigger device in operable communication with the power pack can trigger detonation of the material or cartridge of the firing unit in response to a trigger signal. The power pack of the present invention has multi-triggering capabilities, including, but not limited to, radio-controlled (RC) detonation, victim-operated (VO) detonation, command/hard wired (CW) detonation, and disable power/jamming functions.

Figure 1:
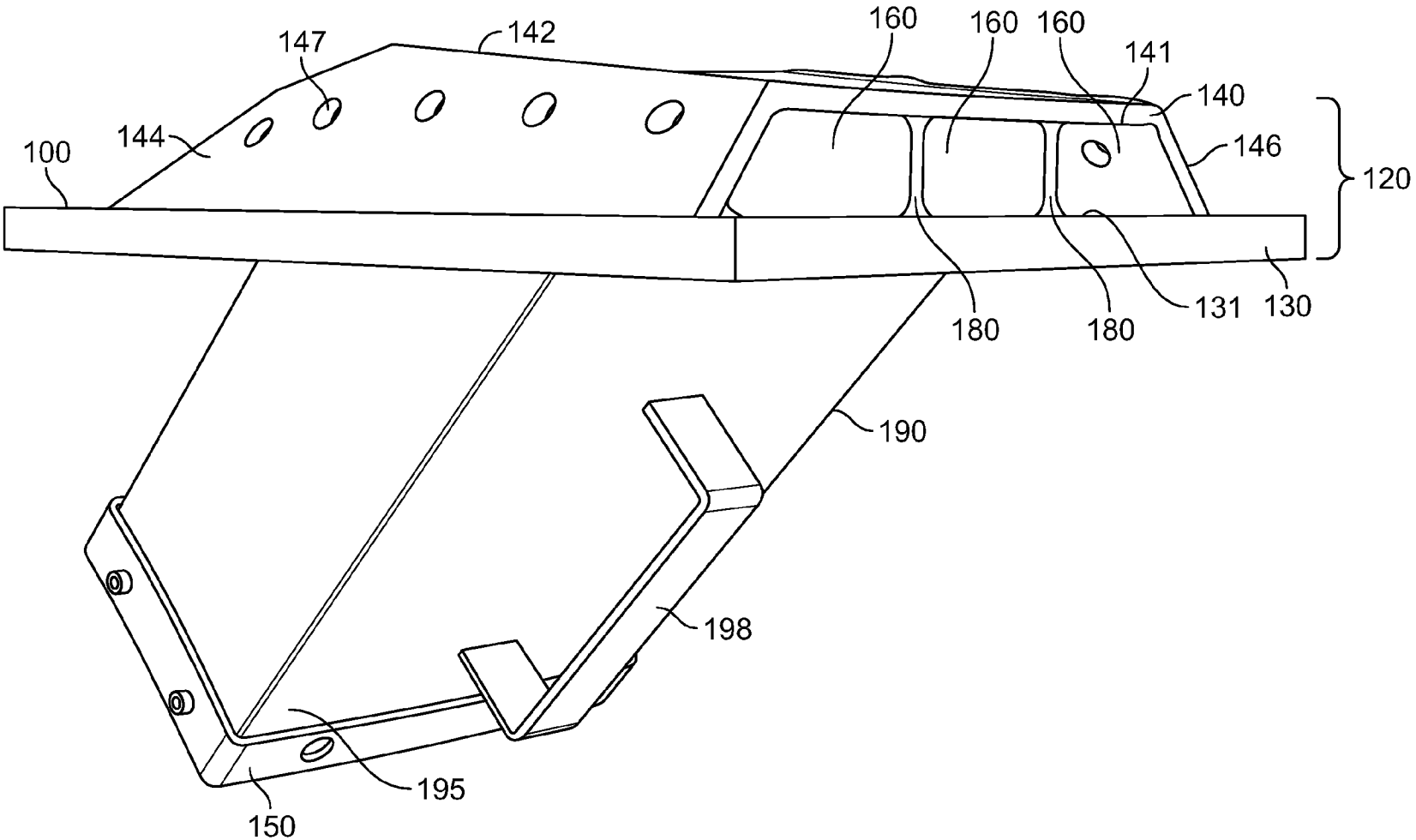
FIG. 1 shows a perspective view of an illustrative embodiment of a landmine simulating device of the present invention.

Embodiments of the present invention and its advantages are best understood by referring to the figures, like numerals being used for like and corresponding parts of the various drawings. FIG. 1 is a perspective view of an illustrative embodiment of a landmine simulator device 100 of the present invention. The device 100 may be referred to as an under vehicle explosive device (UVED). The device 100 is a blast fixture specially configured to allow for the directional control of a blast occurring from the detonation of a firing unit. In general, a firing unit that can be used with the device 100 represents a device operable to simulate one or more distinct signatures, for example, the visual, audio, or both visual and audio signatures, of an explosive device. The blast fixture channels the blast internally for maximum sound, while releasing excess pressure that can result from the blast. The blast resulting from the detonation is channeled low and away from the underside of a vehicle passing by or overhead.

The device 100 includes a top portion 120, which includes a top plate 130 and a blast cover 140. The top plate 130 engages a lower portion 190 that is hollow, such that an opening (not visible in FIG. 1) in the top plate 130 aligns with the lower portion 190. The lower portion 190 of the device 100 is at an approximate 45° angle with respect to the top plate 130. The top plate 130 also engages the blast cover 140. The blast cover 140 includes a top wall 142 that slopes down to engage the top plate 130, and two side walls, 144 and 146 respectively, that also engage the top plate 130. Each of the two side walls 144 and 146, are interrupted with holes 147, which allow for release of a visible signature after the firing unit has been detonated, as well as release of any excess pressure that may exist as a result of the detonation. In an embodiment, two pieces of metal 180 are positioned to create a three-channeled opening 160. The two pieces of metal 180 can be positioned between, and engage to, an inner surface 141 of the top wall 142 of the blast cover 140, and an upper surface 131 of the top plate 130. The opening 160 allows for release of an audio/visual signature after the firing unit has been detonated, as well as release of any excess pressure that may exist as a result of the detonation. The top wall 142 aids in the echoing of the audio signature after detonation, and is capable of producing a concussion effect, a pyrotechnic effect that produces a loud jarring shock that can be felt by the occupants of a vehicle. All of the components of the device 100 can be constructed from one piece of material, or may be constructed by welding, soldering or brazing various pieces of material together. In an embodiment, the material is a metal such as an aluminum or aluminum alloy metal. The hollow lower portion 190 has a handle 198 for easy transportation of the device 100. A reinforcing strap 150 surrounds the distal end 195 of the lower portion 190 and is used to engage the firing unit within a distal end 195 of the lower portion 190, as will be described in more detail with reference to FIG. 3.

Figures 2A, 2B, 2C:
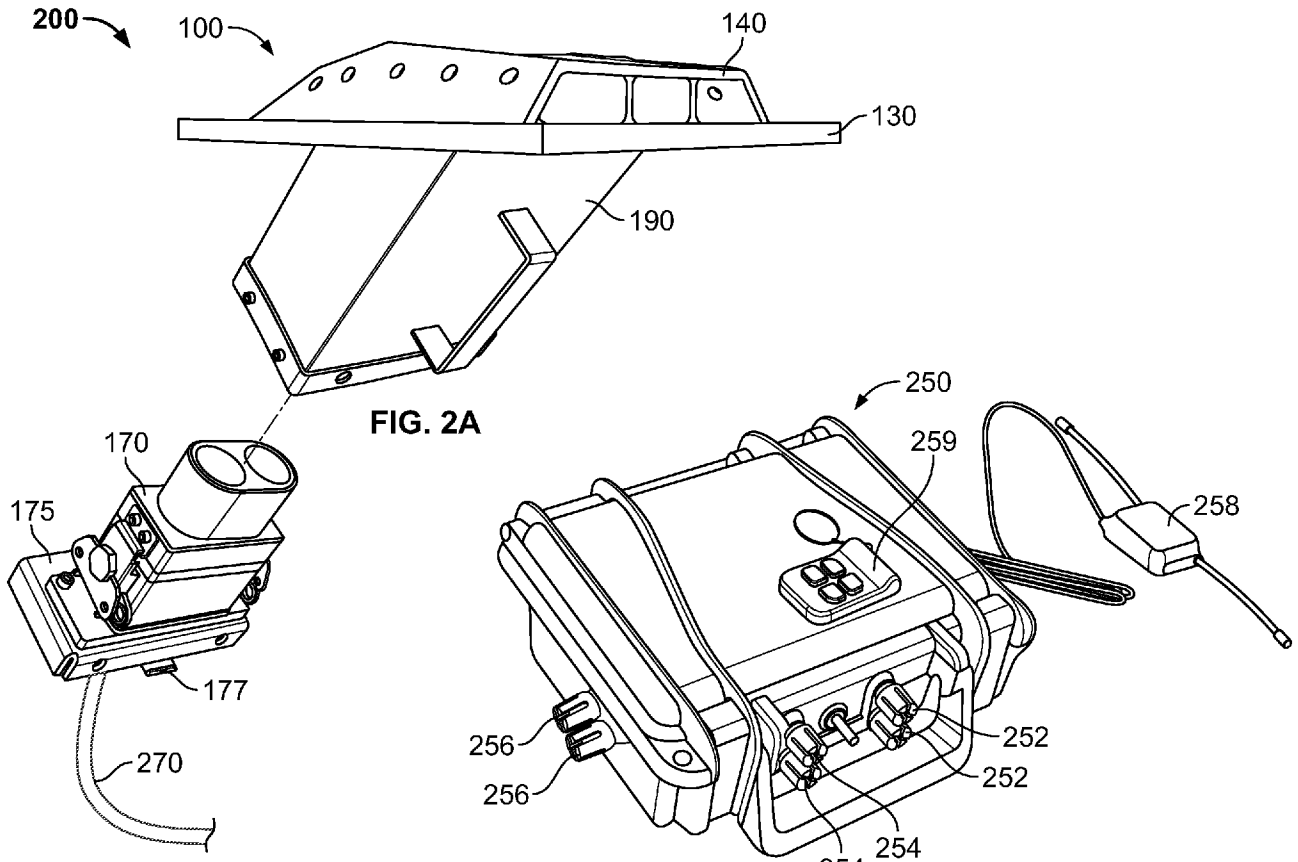
FIGS. 2A, 2B and 2C show perspective views of some of the main components of an illustrative embodiment of a landmine training system of the present invention.

FIGS. 2A, 2B and 2C show perspective views of some of the main components of an illustrative embodiment of a landmine training system 200 of the present invention. The system 200 includes the landmine simulating device 100 (FIG. 2A), a firing unit 170 (FIG. 2B), and a power pack 250 (FIG. 2C). A cable 270 attached to the firing unit 170 attaches to ports 252 on the power pack 250, thus establishing a pathway for communicating a detonation command to the firing unit 170. The firing unit 170 can receive an explosive device, such as a pyrotechnic, or a non-pyrotechnic, cartridge or material. In an embodiment, the firing unit 170 can receive one or more pyrotechnic cartridges that can direct a pyrotechnic explosion in a predetermined direction. The pyrotechnic cartridge includes pyrotechnic material which comprises a chemical mixture that can be used to generate an exothermic reaction by combustion, deflagration, or detonation to produce visual and audio effects. The material may include an oxidizing agent (oxidant) and a fuel that produces the exothermic reaction when heated to its ignition temperature. The pyrotechnic cartridge may have electrical contacts operable to receive a detonation signal to heat the fuel. Any suitable pyrotechnic cartridge that displays an audio and/or visual signature may be used, for example, a type classified Army approved ammunition/pyrotechnic (e.g., M30 rounds or M31 black or yellow smoke).

In an embodiment, the firing unit 170 can hold type classified M30 rounds. The type classified M30 rounds can realistically yet safely simulate the smoke puff (visual) and bang (audio) signatures of an IED, without producing a starburst (flash) signature, such as those found in a type classified M31 rounds. In an embodiment, the device 100 is used during a training exercise to simulate an anti-tank (AT) or other type of landmine. During such a use, it may not be desirable to use a cartridge or material that has a flash starburst-type signature, since the material expelled can become ignited. In an embodiment, the firing unit 170 can hold type classified M31 black or yellow smoke rounds. In an embodiment, the firing unit 170 can hold one type classified M30 round, and one type classified M31 black or yellow smoke round. In an embodiment, the firing unit 170 has two receptacles, each of the receptacles including a first boring having a first diameter, a second boring having a second diameter, which is greater than the first diameter, and a third boring positioned between the first boring and the second boring, the third boring having a third diameter, which is greater than the first diameter but less than the second diameter. The first, second and third diameters can be selected such that each of the receptacles can selectively and interchangeably receive at least two different types of type classified rounds, such as an M30 and an M31 round. In an embodiment, the firing unit 170 has two receptacles, each of the receptacles having a single boring of a single diameter for accepting only one type of type classified round, such as a type classified M30 round. In some embodiments, it may be desirable to use a type classified round that includes a flash starburst-signature, as long as the area near the blast is considered nonflammable, i.e., there are no trees, brush, fuel, or any other material or object that is considered ignitable. In an embodiment, the firing unit 170 can hold non-pyrotechnic material that can direct a non-pyrotechnic explosion in a predetermined direction. Any suitable non-pyrotechnic material that can simulate a visual/audible signature known in the art may be used.

In the illustrative embodiment shown in FIG. 2B, two firing chambers of the firing unit 170 can receive two type classified Army approved rounds. The firing unit 170 includes an electromagnetic interference (EMI) filter for preventing electrostatic discharge. As illustrated in the embodiment depicted in FIG. 2B, the firing unit 170 engages a bottom plate 175 having a handle 177. The handle 177 allows the firing unit 170 to be inserted in, or removed from, the device 100 with ease. Although the embodiments described herein show the device 100 holding one firing unit 170, those skilled in the art will recognize that the dimensions of the device 100 can be adjusted to hold more than one firing unit 170 and any related components and still be within the scope and spirit of the present invention. Additionally, the device 100 can be enlarged or diminished for other landmine applications.

The firing unit 170 is positioned to lock/unlock within a portion of the distal end 195 of the lower portion 190 of the device 100, such that upon receiving a detonation command, a blast will penetrate the hollow lower portion 190 towards the inner surface 141 of the top wall 142 of the blast cover 140, and be channeled out the openings 160, and the two side walls, 144 and 146. The design and shape of the hollow lower portion 190, and the blast cover 140, provide maximum echoing of the audio signature resulting from the blast. The blast is displaced in a controlled direction by the placement of the blast cover 140 and the unique angling of the lower portion 190. Approximately all of the blast is channeled in a horizontal plane out of the opening 160, and the two side walls, 144 and 146, for safety considerations. The firing unit 170 is configured to fire a blast in a direction that minimizes the hazards of the simulation, maximizes the accuracy of the simulation, or both minimizes the hazards and maximizes the accuracy. The blast creates a realistic audio (loud bang) and visual (smoke puff) signature. The firing unit 170 may have any suitable safety radius that designates a region safe from the hazards of an explosion. For example, the firing unit 170 may be have a safety radius of less than 100, 50, 30, 20 or 10 feet.

The power pack 250 represents a device operable to provide power to the firing unit 170, as well as a module operable to control the operation of the firing unit 170. The power pack 250 has multi-triggering user-controlled capabilities that can be switched on or off by a user at anytime during a training simulation (i.e., victim operated (VO)). All triggering methods are electronically isolated from one another. The power pack 250 has the ability to initiate detonation in one of three ways: command/hard wired (CW) detonation, radio-controlled detonation, and victim-operated detonations, such as a pressure plate/switch, a trip wire, a passive infrared detector, that connect to the power pack 250 via plug and play cable connections to isolated external ports. The power pack 250 also has a jammer plug and shunt plug (not visible in FIG. 2) that can be connected to an interrupter cable, which can be connected to an interrupter box which will disable the power pack 250. Disabling of the power pack 250 in such a way may be desirable for certain training exercises to simulate a jammer that may be trying to jam the entire electronics of the power pack 250.

The radio-controlled detonation feature allows a user to enable/disable the victim-operated triggers, while individual control cards within the power pack 250 provide the programming necessary to turn on/off input to the victim operated triggers and various other triggers. Any suitable trigger device operable to detect a trigger event from, for example, a vehicle or a person, and send a trigger signal in response to detecting the event can be used. As a first example, a keyfob transmitter 259 or command wire may detect a user inputting a command, such as pressing a button when a vehicle is close to the device 100. As a second example, a motion sensor may detect motion. As a third example, a photoelectric beam detector may detect disruption of a photoelectric beam. As a fourth example, a trip wire detector may detect movement. As a fifth example, a vibration sensor may detect the vibration of a vehicle movement. As a sixth example, a passive infrared detector may detect a change in infrared radiation. As a seventh example, a pressure plate may detect a change in pressure on a plate. In an embodiment, the power pack 250 has a sixty (60) second safety. The power pack 250 has the ability to add on additional devices in a daisy chain method by use of a plug and play output port.

The power pack 250 has the ability to initiate via plug and play cable connections. The power pack 250 includes various interfaces for connecting with the various multi-triggering user-controlled capabilities, including, but not limited to, ports 254 which connect with a cable leading to a victim-operated trigger, and ports 256 which connect with a cable leading to a command wire. In an embodiment, the command wire input port cannot be blocked.

Transceiver 258 represents a device operable to communicate signals with keyfob transmitter 259 for the radio-controlled detonation of the firing devices of the firing unit 170. For example, transceiver 258 may transmit, receive, or both transmit and receive signals over an air interface. Transceiver 258 may be used to receive signals from keyfob transmitter 259 to trigger detonation of the firing unit 170. Any suitable transceiver 258 may be used. In an embodiment, transceiver 258 comprises a 315 MHz wireless transceiver operable to initiate the operation of device 100 from 250-350 meters, for example, approximately 300 meters. In an embodiment, transceiver 258 comprises a 433 MHz wireless transceiver operable to initiate the operation of device 100 from 250-350 meters, for example, approximately 300 meters. Keyfob transmitter 259 represents a device operable to communicate with device 100 over a wireless link, and may communicate signals to, from, or both to and from, transceiver 258. Keyfob transmitter 259 may include user controls (shown as buttons on the keyfob transmitter 259) that a user may use to send commands to device 100. For example, user controls may include buttons that can be used to turn off the victim operated trigger. Similarly, user controls may include buttons that can be used to turn back on the victim operated trigger.

A charger interface can be used to couple a power supply charger to the power supply of the power pack 250. Other external device interfaces can be used to couple any suitable external device to the power pack 250. An exemplary external device may comprise a hit simulator that simulates projectiles resulting from the detonation. One or more interfaces may be used to perform other suitable operations, such as receive commands or provide information. For example, the interfaces can include an arming switch and a detonation indicator. The arming switch can be used to arm the device 100. The firing unit 170 may not be operable to detonate unless the arming switch is selected to arm system 200. A detonation indicator may indicate when a detonation is about to occur. The detonation indicator may include, for example, a visual or audio signal such as a light or a buzzer. In an embodiment, a beeper can be used to test whether or not the keyfob transmitter 259 is still in range of the power pack 250, by pressing one of the buttons on the keyfob transmitter 259. The beeper also beeps when hot (e.g., after a 60 second safety has elapsed). The beeper also communicates a fault when turning the power pack 250 on. A power supply within the power pack 250 is selected to provide a suitable amount of power over a suitable period of time without requiring recharging. For example, the power supply may comprise a 12 volt rechargeable battery that can operate for two to four weeks before requiring recharging.

Figure 3:
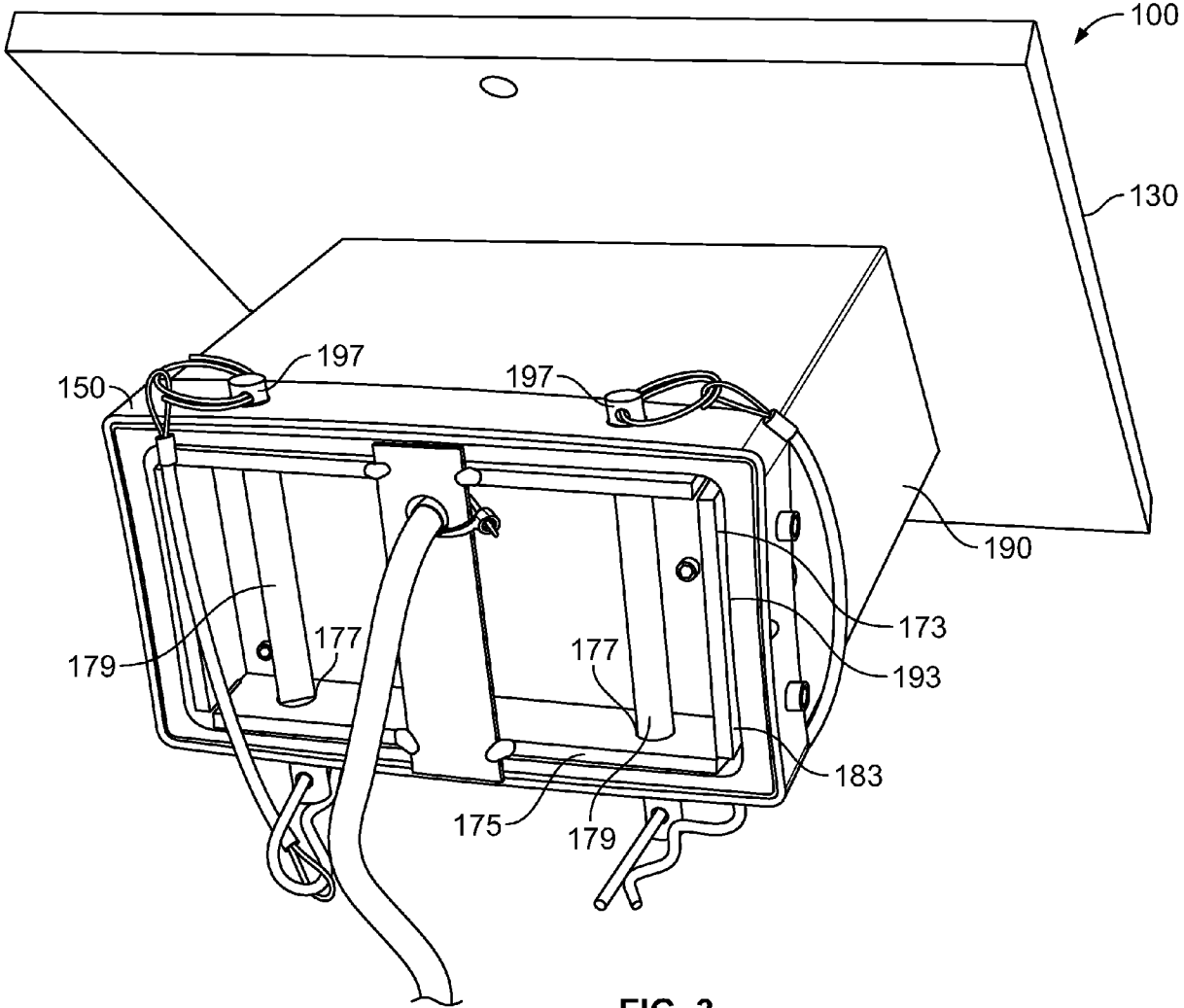
FIG. 3 shows a bottom perspective view of the device illustrated in FIG. 1 housing a firing unit, which provides a material or a cartridge that can simulate a visual/audible signature.

FIG. 3 is a bottom perspective view showing the device 100 housing the firing unit 170 (only the bottom plate 175 of the firing unit 170 is visible). The firing unit 170 is maintained in position within the lower portion 190 via barrel pins 179. The reinforcing strap 150 that surrounds the distal end 195 of the lower portion 190 has holes 197 that align with a corresponding number of holes on a surface of the distal end 195 of the lower portion 190. Similarly, there are a corresponding number of holes 177 in the bottom plate 175 of the firing unit 170. When the firing unit 170 is positioned within the lower portion 190, the barrel pins 179 are placed through all of the holes to lock and maintain the firing unit 170 within the lower portion 190. In an embodiment, when the firing unit 170 is locked in place within the lower portion 190, a small gap 183 exists between an inner surface 193 of the lower portion 190, and an outer surface 173 of the bottom plate 175. This small gap allows relief of back pressure that may result from detonation of the firing unit 170.

Figure 4:
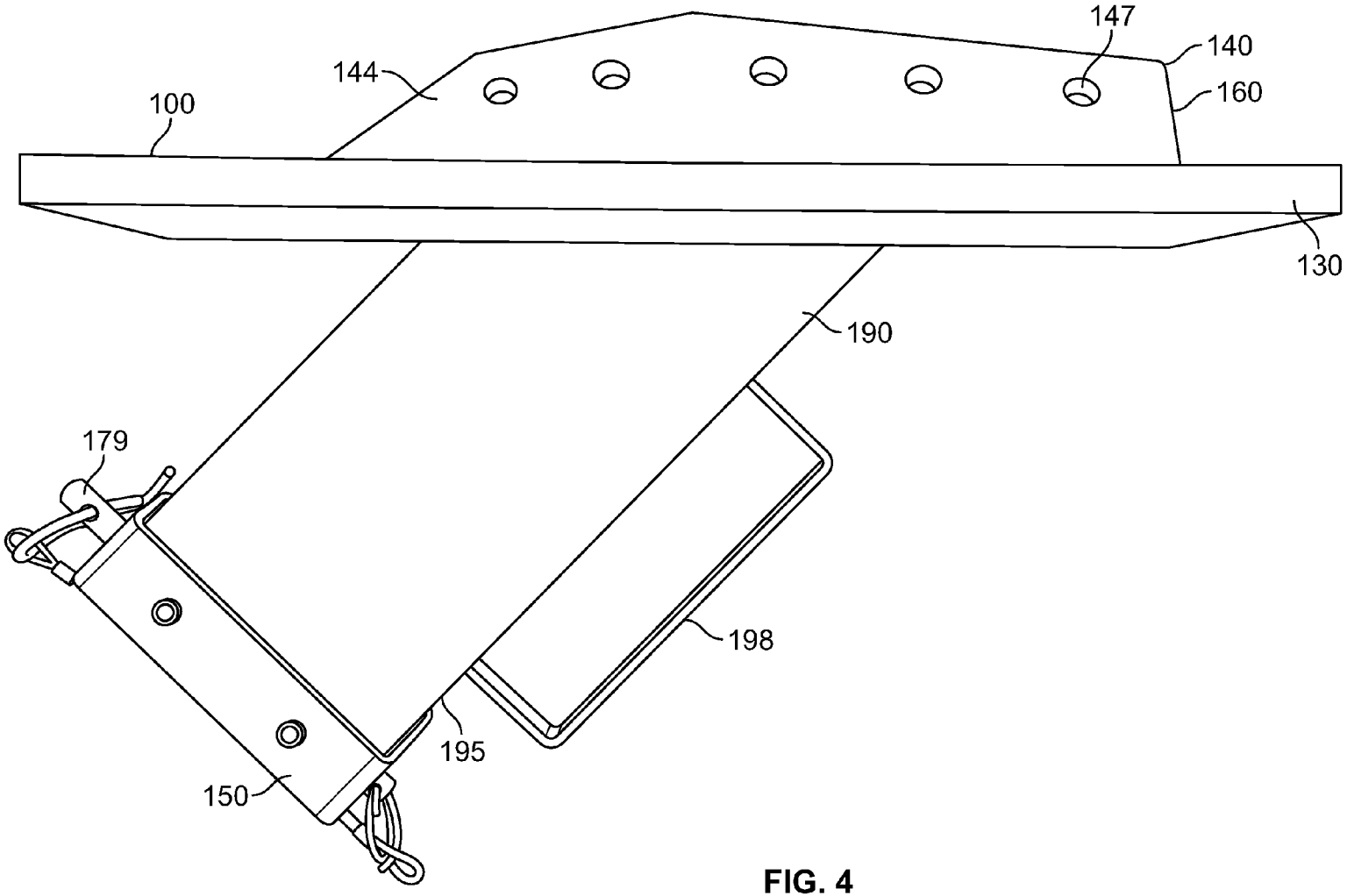
FIG. 4 shows a side view of the device illustrated in FIG. 1 housing a firing unit, which provides a material or a cartridge that can simulate a visual/audible signature.

FIG. 4 is a side view of the device 100 showing the firing unit 170 housed within the distal end 195 of the hollow lower portion 190. The hollow lower portion 190 is at an approximate 45° angle with respect to the top plate 130. This design of the hollow lower portion 190 increases structural integrity of the blast fixture by minimizing upward pressure, while channeling a blast directionally towards the blast openings. The firing unit 170 is placed within the distal end 195 of the lower portion 190 of the device 100, such that firing devices (e.g., type classified M30 rounds) of the firing unit 170 are at an approximate 45° angle with respect to the top plate 130. Thus, after detonation of the firing unit 170, the audio and visual signature from the firing devices will travel along the path of the hollow lower portion 190. The top plate 130 engages the hollow lower portion 190, as well as the blast cover 140. The blast cover 140 includes the top wall 142 that slopes down to engage the top plate 130, and two side walls, 144 and 146 respectively, that also engage the top plate 130. Each of the two side walls 144 and 146, is interrupted with holes 147, which allow for release of a visible signature after the firing unit has been detonated, as well as release of any excess pressure that may exist as a result of the detonation. Those skilled in the art will recognize that any number of holes 147 can interrupt the two side walls 144 and 146, and still be within the scope and spirit of the present invention. Similarly, instead of multiple circular holes 147, there may be one or a few elongated tubular hole(s). The shape, size, and number of holes 147 interrupting the two side walls 144 and 146 are not limited to those recited herein, as long as there is some means of allowing for release of a visible signature after the firing unit has been detonated, as well as release of any excess pressure that may exist as a result of the detonation. The engagement of the top plate 130 with the three-walls of the blast cover 140, creates the opening 160 for release of a visible signature after the firing unit has been detonated, as well as release of any excess pressure that may exist as a result of the detonation. The top wall 142 aids in the echoing of the audio signature after detonation, and is capable of causing a concussion effect, a pyrotechnic effect that produces a loud jarring shock that can be felt by occupants of a vehicle.

Figure 5:
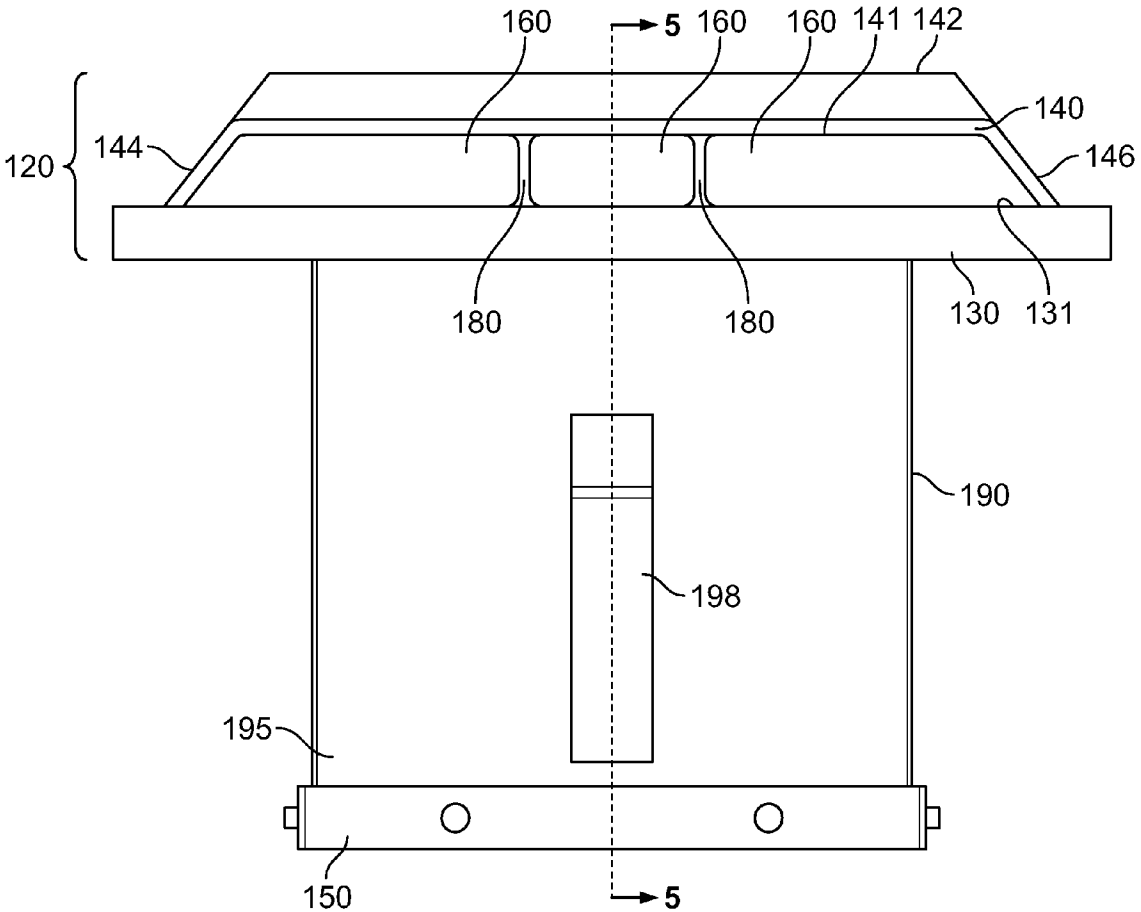
FIG. 5 shows a front elevational view of the device illustrated in FIG. 1.
Figure 6:
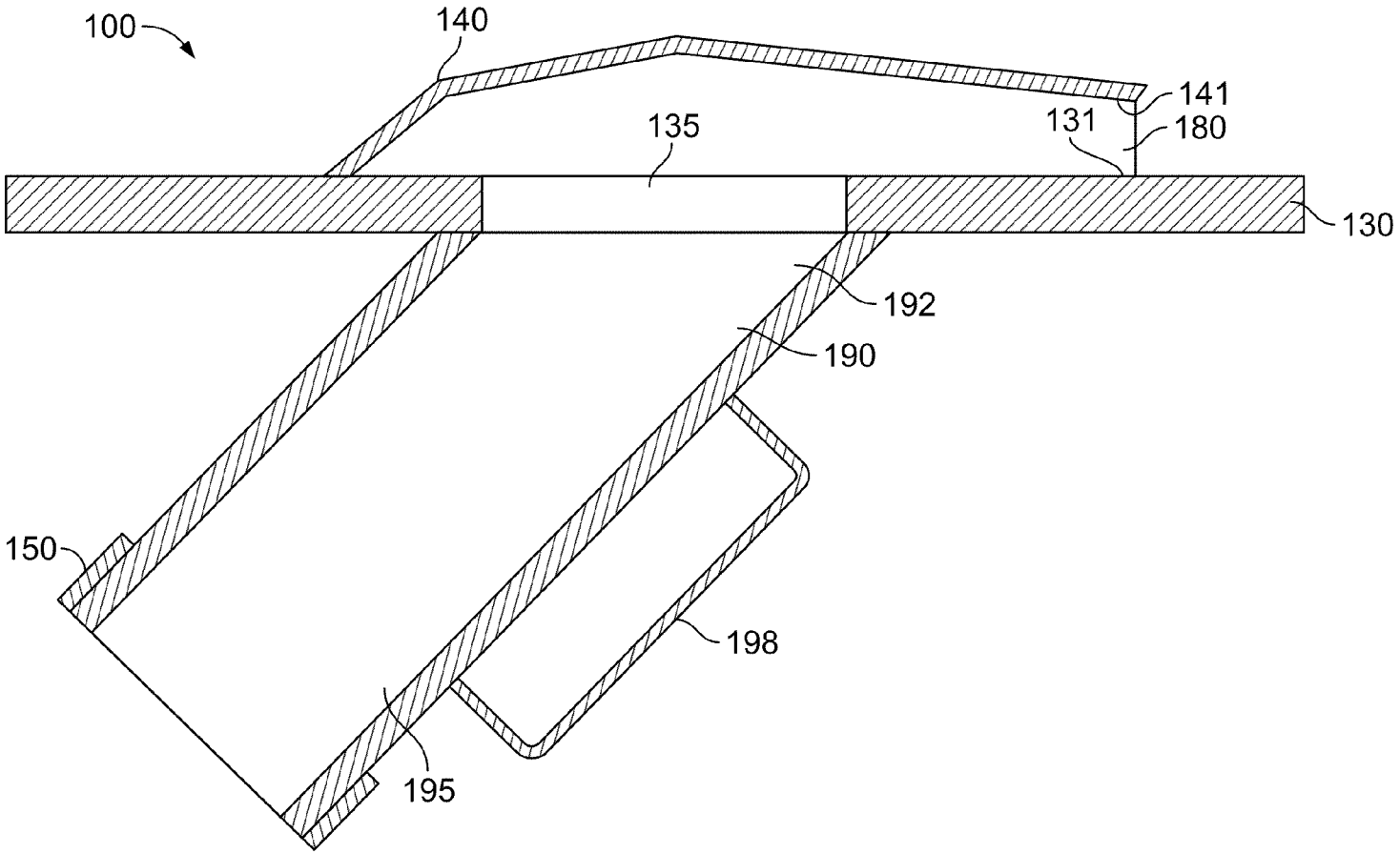
FIG. 6 shows a cross-sectional view of the device illustrated in FIG. 5 taken along line 5-5.

FIG. 5 is a front elevational view of the device 100 and FIG. 6 is a side cross-sectional view of the device 100 of FIG. 5 taken along line 5-5, with the firing unit 170 removed from the distal end 195 of the lower portion 190. As illustrated in FIG. 5, the top plate 130 is wider than the lower portion 190. In an embodiment, the top plate 130 has a width ranging from about ten inches to about twelve inches. In an embodiment, the lower portion 190 has a width ranging from about six inches to about eight inches. In an embodiment, the width of the three openings 160 together ranges from about eight inches to about ten inches. The metal pieces 180 may be positioned between, and engage with the inner surface 141 of the top wall 142 of the blast cover 140, and an upper surface 131 of the top plate 130. Those skilled in the art will recognize that the metal pieces 180 may be positioned anywhere between the top wall 142 and the top plate 130, along the inner surface 141 and the upper surface 131 and still be within the scope and spirit of the present invention.

As illustrated in FIG. 6, the top plate 130 engages the hollow lower portion 190, such that an opening 135 in the top plate 130 aligns with an open proximal end 192 of the hollow lower portion 190. The opening 135 in the top plate provides a passageway for a signature from a blast to travel from the hollow lower portion 190 to the blast cover 140 and out the openings 160 and the holes 147 of the side walls 144 and 146. In the side cross-sectional view shown in FIG. 6, one piece of the metal 180 partition is visible. The metal 180 is positioned between, and engages with the inner surface 141 of the top wall 142 of the blast cover 140, and an upper surface 131 of the top plate 130. In an embodiment, the pieces of metal 180 strengthen the engagement of the blast cover 140 with the top plate 130 at the joints therebetween, acting as load-bearing walls.

Figure 7:
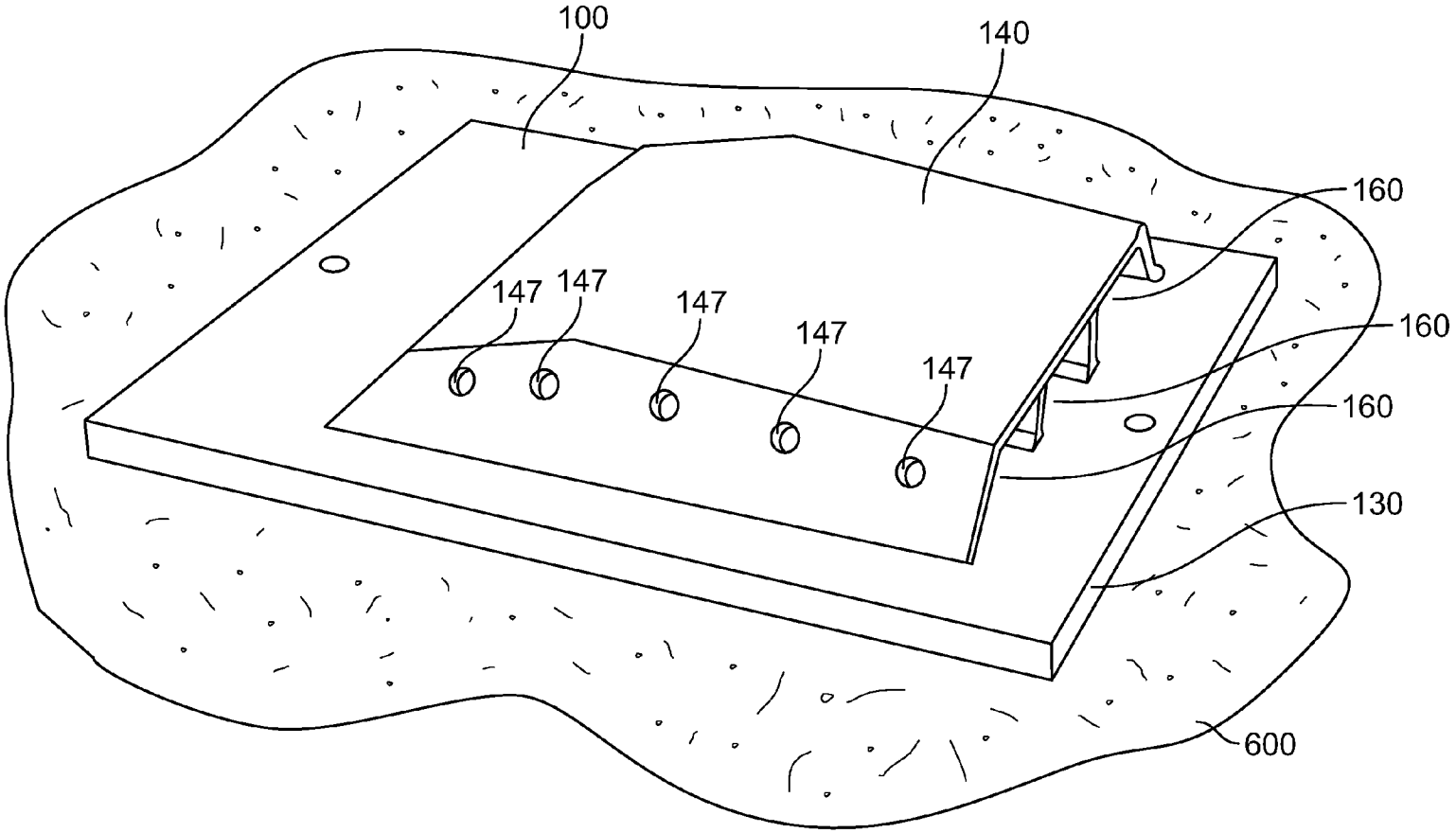
FIG. 7 shows a top perspective view of the device illustrated in FIG. 1 positioned for use during a training exercise for an anti-tank (AT) or other landmine simulation.

FIG. 7 is a top perspective view showing the device 100 positioned for use during a training exercise for an anti-tank (AT) or other type of landmine simulation. The structural design of the device 100 channels a blast internally for maximum sound, while releasing excess pressure that can result from a blast. The main blast resulting from a detonation is channeled low and away from the underside of a vehicle passing by or overhead. For example, the blast may be directed in a horizontal direction parallel to the surface of the earth, while projectiles in a vertical direction perpendicular to the surface of the earth are minimized. Directing blasts in this manner reduces risk of injury to participants The nature of the blast creates a realistic audio (loud bang) and visual (smoke puff) signature of an explosion occurring underneath a moving vehicle. In an embodiment, when a blast occurs, the structural design of the device 100 is capable of producing a concussion effect, so that during the landmine simulation exercise, occupants of the vehicle can feel a shock. For a typical training simulation exercise, the lower portion 190 of the device 100 is buried within the ground 600 (e.g., in dirt, rubble, stones, grass, mud, etc), while the top portion 120 remains above ground. Typically, areas around the top portion 120, such as the holes 147 and the openings 160, would be free of debris. The cable 270 which connects to the firing unit 170, comes out from the ground and connects to the power pack 250, which can be any acceptable distance away from the device 100 (the cable 270, the firing unit 170, and the power pack 250 are not visible in FIG. 7). The power pack 250 is also connected (via ports) to a cable in operable communication with an external triggering device, such as a pressure plate/switch. If the external triggering device function of the power pack 250 has been enabled by a user, as the vehicle passes over the pressure plate/switch, a trigger event is detected by the power pack 250, which sends a detonation signal to the firing unit 170. The power pack 250 can also be connected to a cable in operable communication with a command wire. The power pack 250 is also receiving information from a user via the keyfob transmitter 259. The keyfob transmitter 259 has capabilities to turn off the victim operated trigger, such that logic functions of a circuit board in operable communication with the triggering device are blocked. Similarly, the keyfob transmitter 259 has capabilities to turn back on the victim operated trigger, such that logic functions of the circuit board in operable communication with the triggering device is re-established or unblocked.

Initiation of the detonation causes the power pack 250 to provide the power and logic necessary to detonate the firing devices of the firing unit 170. The detonation of the firing devices generates an explosion or blast which channels through the device 100, causing an echoing of the audible signature. The visual signature would emanate through the holes 147 of the two side walls, 144 and 146, and through the opening 160. The blast cover 140 allows for the visual signature to be released from the device 100 in a substantially parallel direction to the surface of the earth. If the visual signature includes a white cloud of smoke, the cloud of smoke can distribute through the air once released from the device 100. The top wall 142 of the blast cover 140 aids in the echoing of the audio signature after detonation, and is capable of causing a concussion effect, a pyrotechnic effect that produces a loud jarring shock that can be felt by occupants of a vehicle.

It should be understood that the embodiments described herein are merely exemplary and that a person skilled in the art may make many variations and modifications without departing from the spirit and scope of the invention. Accordingly, all such variations and modifications are intended to be included within the scope of the present invention.

What is claimed is:

1. A landmine simulator device comprising:

a blast fixture;

a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover being configured so as to release a visible signature externally for maximum exposure.

2. The landmine simulator device of claim 1 wherein said blast fixture is shaped and sized to be partially buried within ground.

3. The landmine simulator device of claim 1 wherein said blast cover includes a top wall and two side walls sloping down so as to engage said top plate.

4. The landmine simulator device of claim 3 wherein said two side walls are interrupted with at least one opening so as to release excess pressure resulting from a detonation of a firing device housed within said distal end of said lower portion.

5. The landmine simulator device of claim 1 further comprising a firing unit operable to simulate one or more distinct signatures of an explosive device.

6. The landmine simulator device of claim 5 wherein said distinct signatures is chosen from one of a visual signature, an audio signature or combinations thereof.

7. The landmine simulator device of claim 5 wherein said firing unit can receive one or more pyrotechnic cartridges that can direct a pyrotechnic explosion in a predetermined direction.

8. The landmine simulator device of claim 1 wherein said blast cover is configured so as to cause a concussion effect.

9. A landmine training system comprising:

a landmine training simulator device having:

a blast fixture;

a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover being configured so as to release a visible signature externally for maximum exposure;

a firing unit operable to simulate one or more distinct signatures of an explosive device; and a power pack operable to provide power to, and control operation of, said firing unit.

10. The landmine training system of claim 9 wherein said distinct signatures of said firing unit is chosen from one of a visual signature, an audio signature or combinations thereof.

11. The landmine training system of claim 9 wherein said firing unit includes two receptacles each capable of receiving at least two different types of type classified rounds.

12. The landmine training system of claim 11 wherein said receptacles includes a first boring having a first diameter, a second boring having a second diameter, which is greater than said first diameter, and a third boring positioned between said first boring and said second boring, said third boring having a third diameter, which is greater than said first diameter but less than said second diameter.

13. The landmine training system of claim 9 wherein said firing unit can receive one or more pyrotechnic cartridges that can direct a pyrotechnic explosion in a predetermined direction.

14. The landmine training system of claim 13 wherein said pyrotechnic cartridge is a type classified M30 round.

15. The landmine training system of claim 9 wherein said firing unit is housed within said distal end of said lower portion.

16. The landmine training system of claim 9 wherein said blast cover is configured so as to produce a concussion effect when said explosive device is detonated.

17. The landmine training system of claim 9 wherein said power pack has multi-triggering capabilities.

18. The landmine training system of claim 17 wherein said multi-triggering capabilities is chosen from one of radio-controlled (RC) detonation, victim-operated (VO) detonation, command/hard wired (CW) detonation, disable power/jamming functions, or combinations thereof.

19. The landmine training system of claim 18, wherein said victim-operated detonation is chosen from one of a pressure plate/switch, a trip wire, a passive infrared detector or combinations thereof.

20. A landmine training system comprising:

a landmine training simulator device having:

a blast fixture;

a lower portion of said blast fixture having a proximal end, a distal end and a hollow area therebetween, said hollow area being configured so as to direct channeling of an audio signature internally for maximum sound; and a top portion of said blast fixture having a top plate and a blast cover, said top plate having an opening for engaging and aligning with said proximal end of said lower portion, and said blast cover including a top wall and two side walls sloping down so as to engage said top plate, and being configured so as to release a visible signature externally for maximum exposure, and being configured so as to produce a concussion effect, said two side walls interrupted with at least one opening so as to release excess pressure resulting from a detonation;

a firing unit positioned within said distal end of said lower portion and operable to simulate an audio and a visible signature of a type classified round, said firing unit including two receptacles each capable of receiving at least two different types of type classified rounds, each of said receptacles having a first boring having a first diameter, a second boring having a second diameter, which is greater than said first diameter, and a third boring positioned between said first boring and said second boring, said third boring having a third diameter, which is greater than said first diameter but less than said second diameter;

a power pack in operable communication with said firing unit, said power pack providing power to control operation of said firing unit, said power pack having multi-triggering user-controlled capabilities chosen from one of radio-controlled (RC) detonation, victim-operated (VO) detonation, command/hard wired (CW) detonation, disable power/jamming functions, or combinations thereof; and at least one external triggering device in operable communication with said power pack by way of plug and play cable connection, said triggering device controllable by a user to trigger detonation of said type classified rounds.

* * * * *